US012551983B2

(12) United States Patent
Xu et al.

(10) Patent No.: US 12,551,983 B2
(45) Date of Patent: Feb. 17, 2026

(54) LARGE AREA QUARTZ CRYSTAL WAFER LAPPING DEVICE AND A LAPPING METHOD THEREOF

(71) Applicant: TANGSHAN GUOXIN JINGYUAN ELECTRONICS CO., LTD., Tangshan (CN)

(72) Inventors: Jianmin Xu, Tangshan (CN); Jie Ding, Tangshan (CN); Yong Zhang, Tangshan (CN); Liang Wang, Tangshan (CN); Hao Su, Tangshan (CN); Jianxing Di, Tangshan (CN); Jianjun Hao, Tangshan (CN); Yingchun Zhang, Tangshan (CN); Huaen Wang, Tangshan (CN); Xianling Zhang, Tangshan (CN); Lizhi Cui, Tangshan (CN)

( * ) Notice: Subject to any disclaimer, the term of this patent is extended or adjusted under 35 U.S.C. 154(b) by 380 days.

(21) Appl. No.: 18/301,221

(22) Filed: Apr. 15, 2023

(65) Prior Publication Data

US 2023/0249312 A1 Aug. 10, 2023

Related U.S. Application Data

(63) Continuation of application No. PCT/CN2022/139437, filed on Dec. 16, 2022.

(30) Foreign Application Priority Data

Dec. 20, 2021 (CN) ..... 202111557783.X

(51) Int. Cl.
*B24B 37/04* (2012.01)
*B24B 37/10* (2012.01)
(Continued)

(52) U.S. Cl.
CPC ..... *B24B 37/044* (2013.01); *B24B 37/105* (2013.01); *B24B 37/32* (2013.01); *B24B 37/34* (2013.01)

(58) Field of Classification Search
CPC ..... B24B 7/228; B24B 37/005; B24B 37/013; B24B 37/07; B24B 37/10; B24B 37/102;
(Continued)

(56) References Cited

U.S. PATENT DOCUMENTS 2,971,298 A * 2/1961 Garthwaite ..... B24B 37/102 451/286
2,994,993 A * 8/1961 Jones ..... B24B 37/102 451/286
(Continued)

FOREIGN PATENT DOCUMENTS

CN 201115926 Y * 9/2008
CN 102601724 A * 7/2012
(Continued)

OTHER PUBLICATIONS

Translation of KR 20120126410 A (Year: 2012).*
(Continued)

*Primary Examiner* — David S Posigian
*Assistant Examiner* — Steven Huang

(57) ABSTRACT

A large area quartz crystal wafer lapping device, provided with a base, a supporting arm assembly, a lapping plate, a swivel gantry, a rotating motor, a loading block and a plate-Adjusting ring; The supporting arm assembly comprises a swing arm, a swing arm shaft, a swing arm motor, an adjustable arm and a roller; The swivel gantry is driven to rotate by the rotating motor; The loading block is encased in the plate-Adjusting ring, and a quartz crystal wafer is bonded to the bottom surface of the loading block. In the invention, through the improved design of material removal
(Continued)

and wafer retention, the processing surface shape of large area quartz crystal wafer can meet the design requirements.

7 Claims, 6 Drawing Sheets

(51) Int. Cl.
*B24B 37/32* (2012.01)
*B24B 37/34* (2012.01)

(58) Field of Classification Search
CPC ..... B24B 37/105; B24B 37/12; B24B 37/30; B24B 37/32; B24B 37/345; B24B 41/005; B24B 49/00; B24B 49/006; B24B 51/00; B24B 57/02; B24B 13/005; B24B 13/0052; B28D 5/0058; B28D 5/0064; B28D 5/007; B28D 5/0082; B28D 5/0088; B28D 7/005; B28D 7/04; B28D 7/024; B28D 7/241; C09G 1/02; C09K 3/1436
See application file for complete search history.

(56) References Cited

U.S. PATENT DOCUMENTS 5,637,031 A * 6/1997 Chen ..... B24B 37/005 451/41
6,250,991 B1 * 6/2001 Afif ..... B24B 37/30 384/549
2013/0130596 A1 * 5/2013 Matsui ..... C09G 1/02 252/79.1
2014/0182633 A1 * 7/2014 Lin ..... B24B 55/00 134/36
2014/0220863 A1 * 8/2014 Wu ..... B24B 37/005 451/11

FOREIGN PATENT DOCUMENTS

CN 104760145 A * 7/2015 ..... B28D 5/0082
CN 207858579 U * 9/2018
CN 108748738 A * 11/2018 ..... B28D 5/0082
CN 110587382 A * 12/2019 ..... B24B 37/30
CN 112192348 A 1/2021
CN 112277176 A * 1/2021 ..... B28D 5/0082
GB 2239618 A * 7/1991 ..... B24B 37/30
JP H09285950 A 11/1997
JP 2010212522 A * 9/2010
KR 20120126410 A * 11/2012 ..... B24B 37/04
WO WO-0204171 A1 * 1/2002 ..... B24B 37/30

OTHER PUBLICATIONS

Translation of CN 102601724 A (Year: 2012).*
Translation of CN 110587382 A (Year: 2019).*
Translation of CN 201115926 Y (Year: 2008).*
Translation of CN 112277176 A (Year: 2021).*
Translation of CN 104760145 A (Year: 2015).*
Translation of JP 2010212522 A (Year: 2010).*
Translation of CN 207858579 U (Year: 2018).*
Translation of CN 108748738 A (Year: 2018).*

* cited by examiner

LARGE AREA QUARTZ CRYSTAL WAFER LAPPING DEVICE AND A LAPPING METHOD THEREOF

CROSS-REFERENCE TO RELATED APPLICATION

The application claims priority of Chinese patent application No. 202111557783.X, filed on Dec. 20, 2021, the entire contents of which are incorporated herein by reference.

TECHNICAL FIELD

The invention relates to a quartz crystal wafer lapping device and a lapping method thereof, in particular to a large area quartz crystal wafer lapping device and a lapping method thereof.

BACKGROUND TECHNOLOGY

Quartz single crystal thin wafer (simplified as quartz crystal wafer) is the core component of the quartz oscillator and the performance index (such as the frequency of the quartz crystal) is an important factor affecting the quality of quartz crystal oscillator. In the case of a certain angle, the surface quality and thickness of the quartz crystal wafer determine its frequency. The good surface quality of the quartz crystal wafer can effectively improve the force-frequency characteristics of the resonator. Any small defect on the surface of quartz crystal wafer will affect the working accuracy and reliability of components, so the processing precision of quartz crystal wafer is required at nanometer level.

In processing quartz crystal wafer, the requirement of the workpiece flatness can be satisfied through lapping, then the damage caused by lapping is removed through polishing to obtain ultra-smooth surface. Two-sided lapping with fixed abrasive is an effective process method contains both high surface quality and high profile accuracy, the adhesive error of the paraffin in process and the deformation caused by the stress difference between the two surfaces of the wafer can be improved; However, the quartz crystal thin wafer has a large radius-thickness ratio and thinner thickness. The close contact between the quartz crystal thin wafer with large area and the lapping plate during two-sided lapping will increase the resistance in processing, resulting in the damage of the thin wafer. Therefore, the two-sided lapping is mainly suitable for ultra-precision processing of thicker wafers, not suitable for the processing of the quartz crystal thin wafer.

SUMMARY

The invention provides a large area quartz crystal wafer lapping device and a lapping method thereof, which adopts single-sided lapping device to make rough and fine lapping processing on two surfaces respectively. Through the improved design of material removal and wafer retention, the processing surface shape of large area quartz crystal wafer can meet the design requirements.

To achieve the above object, the following technical schemes are adopted in the invention:

A large area quartz crystal wafer lapping device, provided with a base, a supporting arm assembly, a lapping plate, a swivel gantry, a rotating motor, a loading block and a plate-adjusting ring; The base is in square arranged on a horizontal plane, and the supporting arm assembly is installed at both ends of the diagonal of the base; The supporting arm assembly comprises a swing arm, a swing arm shaft, a swing arm motor, an adjustable arm and a roller; The lower end of the swing arm shaft is connected with the swing arm motor, and the upper end is fixed with one end of the swing arm; The middle part of the swing arm is fixed with one end of the adjustable arm, and the roller is mounted on both the swing arm and the other end of the adjustable arm; The lapping plate is installed on the swivel gantry that is driven to rotate by the rotating motor; The loading block is encased in the plate-adjusting ring, and a quartz crystal wafer is bonded to the bottom surface of the loading block.

The above large area quartz crystal wafer lapping device is further provided with a dropper that arranged on a platform behind the base; The discharge port of the dripping tube of the dropper is located above the middle of the lapping plate.

The above large area quartz crystal wafer lapping device, wherein, the adjustable arm is arc-shaped, and an assemble hole with a long hole structure is arranged in the middle of the swing arm and one end of the adjustable arm; The swing arm is fixed to the adjustable arm by a bolt assembly through the assemble hole.

The above large area quartz crystal wafer lapping device, wherein, the supporting arm is further provided with a locking knob, through which, the swing arm shaft is fixedly connected with the output shaft of the swing arm motor.

The above large area quartz crystal wafer lapping device, wherein, the bottom surface of the lapping plate is provided with three groups of location pins uniformly arranged along the circumference; Three groups of location holes matched with the location pins are arranged on the swivel gantry.

A large area quartz crystal wafer lapping method, the above lapping device is used to finish large area quartz crystal wafer surface lapping operation. First, the quartz crystal wafer thinned to a certain thickness is bonded to the loading block with wax, and then the two surfaces are lapped roughly and finely respectively with alumina, silicon carbide, boron carbide or diamond to remove the damage defects on surface and subsurface of the quartz crystal wafer;

The surface fineness and the damage depth of the subsurface is controlled to achieve the required thickness and surface fineness; The specific operation steps are as follows:

a. Sticking the sample: Putting the loading block and quartz crystal wafer on the heating platform and heat to 80° C.; Spreading paraffin evenly on one end face of the loading block; Placing some quartz crystal wafers on the loading block evenly and squeezing gently to remove bubbles and excess paraffin; Taking the loading block down and putting heavy object on it to cool, and then using alcohol to clean up the excess paraffin at the edge of the sheet.
b. The debugging of the lapper: Releasing the locking knob in the two supporting arm assemblies, the swing arm is moved to the outside of the base; Putting the lapping plate on the swivel gantry; Through positioning by the three location pins and three location holes on the swivel gantry, the two swing arms are moved back; Adjusting the angle of the two rollers in each group of supporting arm assembly to 90°-150° and the swing arm is moved up and down so that the roller on the swing arm is located at ½ height of the plate-adjusting ring. Then the axial position of the adjustable arm is adjusted on the basis of the plate-adjusting ring; When the adjustable arm moves to the outermost side, the plate-adjusting ring can protrude the lapping plate, and when moves to the innermost side, the plate-adjusting ring can pass through the center of the lapping plate, and then the locking knob is locked tightly.

c. Adjusting the lapping plate: Adjusting the position of the dripping tube and opening the dropper; After a proper amount of abrasive is dropped on the lapping plate, putting the spare loading block and encasing the plate-adjusting ring; Resetting the speed of the lapping device to zero, opening the lapping device to adjust the rotating speed of the rotating motor, and adjusting the swing arm motor to the maximum speed to Adjust the lapping plate. After adjusting, cleaning the lapping plate, loading block and plate-adjusting ring with clean water. Then installing the lapping plate according to the step b;

d. Lapping the quartz crystal wafer: Dripping proper abrasive on the lapping plate through the dropper, the loading block with the quartz crystal wafer is placed upside down on the lapping plate and is encased with the plate-adjusting ring; After setting the lapping duration, opening the lapping device; Adjusting the rotating speed of the rotating motor to rotate the lapping plate; The loading block moves back and forth horizontally driven by the roller in the supporting arm assembly; The lapping device stops running until reaching the lapping duration;

e. Adjusting the lapping plate again: Taking the loading block, plate-adjusting ring and lapping plate down, washing with clean water, and then adjusting the plate again according to the step c;

f. Lapping the quartz crystal wafer secondly: after adjusting and cleaning, second lapping is made on the quartz crystal wafer according to the step d;

g. Cleaning: After lapping, cleaning the loading block, plate-adjusting ring and lapping plate that attached with wafer with clean water; Clean the wafer and surroundings thereof with alcohol.

The above large area quartz crystal wafer lapping method, in the step c to f, the hardness of the selected abrasive is more than 9; The diameter of abrasive particles is less than 5 μm; The shape of abrasive particles is regular polygon; The ratio of abrasive weight is 1200# $B_4C$: 5.5%; 1000# SiC: 18.8%; 1000# $Al_2O_3$: 75.7%; The weight ratio error is no more than 0.3% of the total abrasive weight.

The above large area quartz crystal wafer lapping method, in the step c, the weight of the loading block is 5 kg, the rotating speed of the lapping plate is 50 rpm and the lapping duration of the plate-pairing is 20 min.

The above large area quartz crystal wafer lapping method, in the step d, the weight of the loading block is 5 kg, the rotating speed of the lapping plate is 50 rpm and the lapping duration is 30 min.

The above large area quartz crystal wafer lapping method, in the step f, the weight of the loading block is 5 kg, the rotating speed of the lapping plate is 50 rpm and the lapping duration is 15 min.

The invention provides a large area quartz crystal wafer lapping device, through rotating motor and swivel gantry to rotate the lapping plate; The swing arm is driven to swing left and right by the swing arm motor and the swing arm shaft, and then the plate-adjusting ring and the loading block encased in the plate-adjusting ring are driven by the roller on the swing arm to move on the lapping plate, realizing the lapping of the quartz crystal wafer surface bonded to the bottom of the loading block. The large area quartz crystal wafer lapping device of the invention can adjust the pressure applied on the quartz crystal wafer by adjusting the weight of the loading block to remove the damage defects of the quartz crystal wafer surface and subsurface to control the surface fineness and the damage depth of the subsurface. The invention further provides a large area quartz crystal wafer lapping method, which aims to make rough and fine lapping on the two surfaces respectively with abrasive alumina, silicon carbide, boron carbide or diamond of different sizes through the large area quartz crystal wafer lapping device, realizing the lapping of the large area quartz crystal wafer, the processing surface shape of large area quartz crystal wafer can meet the design requirements.

Figure 1:
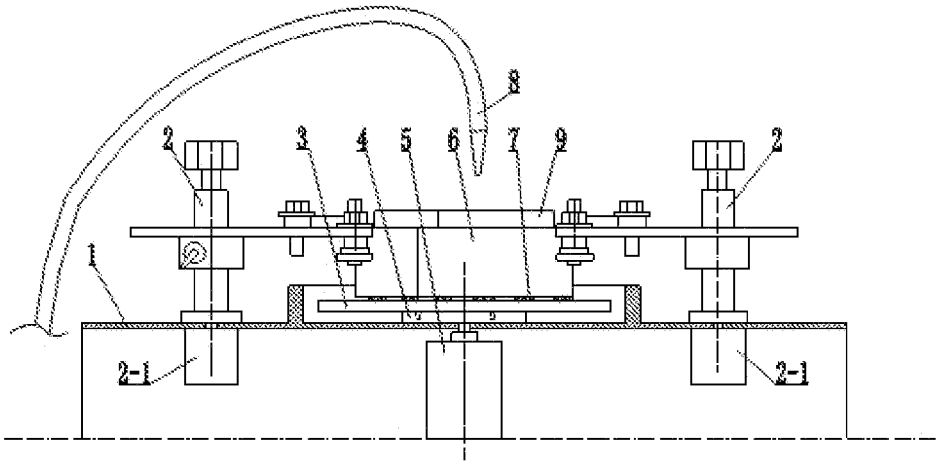
FIG. 1 is a schematic diagram of the large area quartz crystal wafer lapping device of the invention.

In the picture:

1. Base; 2. Supporting arm assembly; 2-1. Swing arm motor; 2-2. Swing arm; 2-3. Adjustable arm; 2-4. Swing arm shaft; 2-5. Roller; 2-6. Bolt assembly; 2-7. Locking knob; 3. Lapping plate; 4. Rotating plate; 5. Swivel gantry; 6. plate-adjusting ring; 7. Quartz crystal wafer; 8. Dripping tube; 9. Loading block.

DETAILED DESCRIPTION OF THE EMBODIMENTS

Further description of the invention is stated in combination with the attached drawings and specific examples.

Referring to FIGS. 1 to 4, a large area quartz crystal wafer lapping device provided in the invention is provided with a base 1, a supporting arm assembly 2, a lapping plate 3, a swivel gantry 4, a rotating motor 5, a loading block 9, a plate-adjusting ring 6 and a dropper; The base 1 is in square arranged on a horizontal plane, and the supporting arm assembly 2 is installed at both ends of the diagonal of the base 1; The dropper is arranged on the platform behind the base 1; The discharge port of the dripping tube of the dropper is located above the middle of the lapping plate 3 that is installed on the swivel gantry 4; The bottom surface of the lapping plate 3 is provided with three groups of location pins uniformly arranged along the circumference; Three groups of location holes matched with the location pins are arranged on the swivel gantry 4 that is driven by the rotating motor 5; The loading block 9 is encased in the in plate-adjusting ring 6, and a plurality of groups of quartz crystal wafers 7 are bonded to the bottom of the loading block 9.

Figure 2:
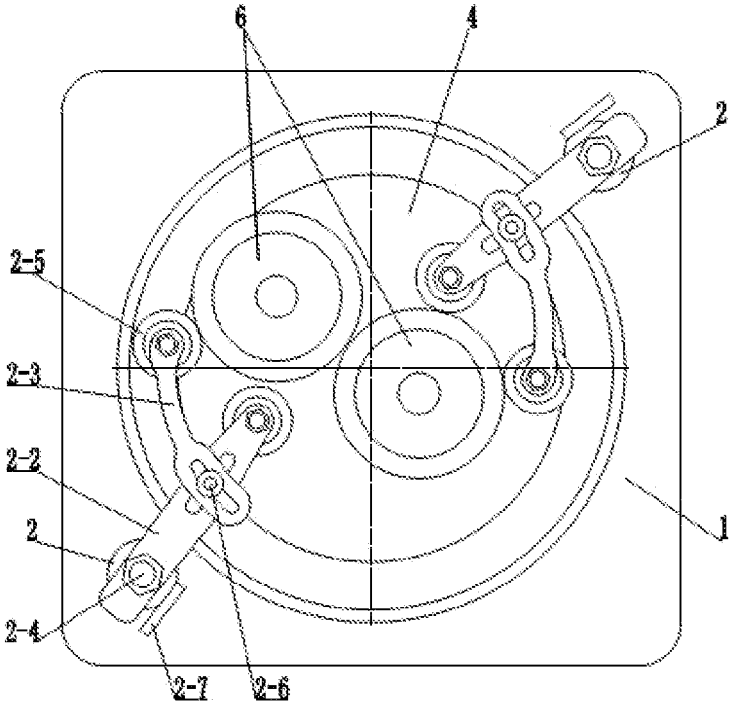
FIG. 2 is a top view of FIG. 1.
Figure 3:
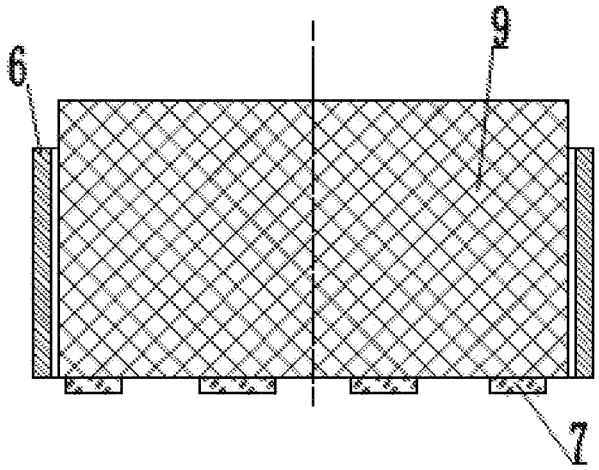
FIG. 3 is a schematic diagram of the assembly relationship between the plate-adjusting ring, the loading block and the quartz crystal wafer.
Figure 4:
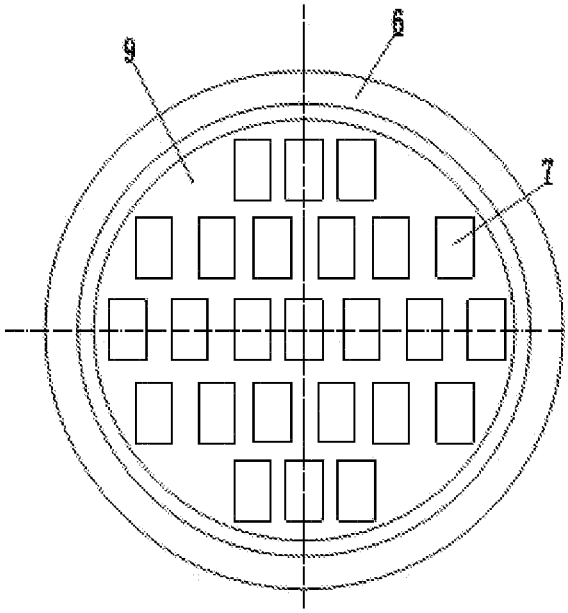
FIG. 4 is a vertical view of FIG. 3.

Referring to FIG. 2, the large area quartz crystal wafer lapping device in the invention, wherein, the supporting arm assembly 2 comprises a swing arm 2-2, a swing arm shaft 2-4, a swing arm motor 2-1, an adjustable arm 2-3, a roller 2-5 and a locking knob 2-7; The lower end of the swing arm shaft 2-4 is connected with the output shaft of the swing arm motor 2-1 through the locking knob 2-7; The upper end of the swing arm shaft 2-4 is fixed with one end of the swing arm 2-2; The middle part of the swing arm 2-2 is fixed with one end of the adjustable arm 2-3, and the roller 2-5 is mounted on both the swing arm 2-2 and the other end of the adjustable arm 2-3; The adjustable arm 2-3 is arc-shaped, an assemble hole with a long hole structure is arranged in the middle of the swing arm 2-2 and one end of the adjustable arm 2-3; The swing arm 2-2 is fixed to the adjustable arm 2-3 by a bolt assembly 2-6 through the assemble hole.

Figure 5:
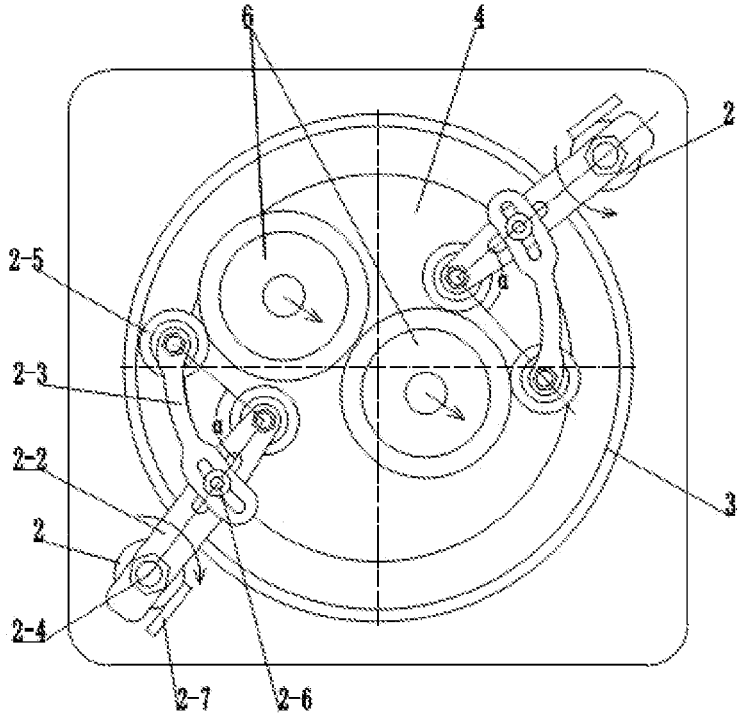
FIG. 5 and FIG. 6 are schematic diagrams of lapping process of the large area quartz crystal wafer lapping device of the invention.
Figure 6:
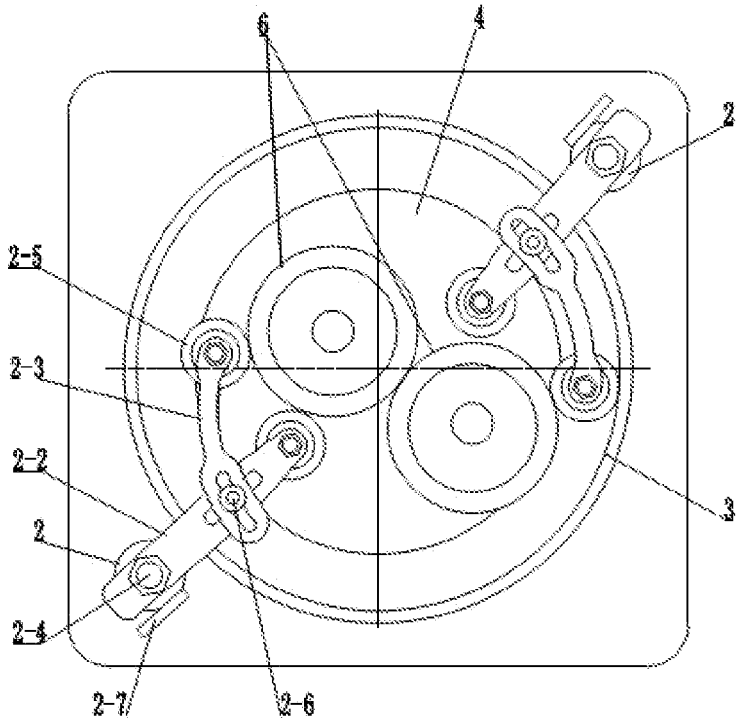

Referring to FIGS. 5 and 6, in the large area quartz crystal wafer lapping method of the invention, the above lapping device is used to finish large area quartz crystal wafer surface lapping operation. First, the quartz crystal wafer thinned to a certain thickness is bonded to the loading block 9 with wax, and then the two surfaces are lapped roughly and finely respectively with alumina, silicon carbide, boron carbide or diamond to remove the damage defects on surface and subsurface of the quartz crystal wafer 7, and the surface fineness and the damage depth of the subsurface is controlled to achieve the required thickness and surface fineness; The above abrasives are alumina, silicon carbide, boron carbide, etc, and the hardness of the abrasive is more than 9; The diameter of abrasive particles is less than 5 μm; The shape of abrasive particles is regular polygon; The ratio of abrasive weight is 1200# $B_4C$: 5.5%; 1000# SiC: 18.8%; 1000# $Al_2O_3$: 75.7%; The weight ratio error is no more than 0.3% of the total abrasive weight. The specific operating steps are as follows:

a. Sticking the sample: Putting the loading block 9 and quartz crystal wafer 7 on the heating platform and heat to 80° C.; Spreading paraffin evenly on one end face of the loading block 9; Placing some quartz crystal wafers 7 on the loading block 9 evenly and squeezing gently to remove bubbles and excess paraffin; Taking the loading block 9 down and putting heavy object on it to cool, and then using alcohol to clean up the excess paraffin at the edge of the sheet.

b. The debugging of the lapper: Releasing the locking knob 2-7 in the two supporting arm assemblies 2, the swing arm 2-2 is moved to the outside of the base 1; Putting the lapping plate 3 on the swivel gantry 4; Through positioning by the three location pins and three location holes on the swivel gantry, the two swing arms 2-2 are moved back; Adjusting the angle of the two rollers 2-5 in each group of supporting arm assembly 2 to 90° to 150° and the swing arm 2-2 is moved up and down so that the roller 2-5 is located at the ½ height of the plate-adjusting ring 6. Then the axial position of the adjustable arm 2-3 is adjusted on the basis of the plate-adjusting ring 6, when the adjustable arm 2-3 moves to the outermost side, the plate-adjusting ring 6 can protrude the lapping plate 3; When moves to the innermost side, the plate-adjusting ring 6 can pass through the center of the lapping plate 3, and then the locking knob 2-7 is locked tightly.

c. Adjusting the lapping plate: Adjusting the position of the dripping tube 8 and opening the dropper; After a proper amount of abrasive is dropped on the lapping plate 3, putting the spare loading block 9 (the weight of the loading block 9 is 5 kg) and encasing the plate-adjusting ring 6 on the outer of the loading block 9; Resetting the speed of the lapping device to zero, opening the lapping device to adjust the rotating speed of the rotating motor 5, and adjusting the swing arm motor 2-1 to the maximum speed to Adjust the lapping plate 3. After adjusting, cleaning the lapping plate 3, loading block 9 and plate-adjusting ring 6 with clean water. Then installing the lapping plate 3 according to the step b;

d. Lapping the quartz crystal wafer: Dripping proper abrasives on the lapping plate through the dropper, the loading block 9 (the weight of the loading block 9 is 5 kg) with the quartz crystal wafer 7 is placed upside down on the lapping plate 3 and is encased with the plate-adjusting ring 6; After setting the lapping duration, opening the lapping device; Adjusting the rotating speed of the rotating motor 5 as 50 rpm; Adjusting the swing arm motor 2-1 to the maximum speed to rotate the lapping plate 3. The loading block 9 moves back and forth horizontally driven by the roller 2-5 in the supporting arm assembly 2; The lapping device stops running after 30 minutes of lapping;

e. Adjusting the lapping plate again: Taking the loading block 9, plate-adjusting ring 6 and lapping plate 3 down and washing with clean water, and then adjusting the plate again according to the step c;

f. Lapping the quartz crystal wafer secondly: After adjusting and cleaning, second lapping is made on the quartz crystal wafer 7 according to the step d and the lapping duration is 15 min;

g. Cleaning: After second lapping, cleaning the loading block 9, plate-adjusting ring 6 and lapping plate 3 that bonded with quartz crystal wafer 7 with clean water; Cleaning the quartz crystal wafer 7 and surroundings thereof with alcohol.

What is claimed is:

1. A large area quartz crystal wafer lapping method, characterized by:

adopting a lapping device to finish quartz crystal wafers; the lapping device provided with:

a base (1), two supporting arm assemblies (2), a lapping plate (3), a swivel gantry (4), a rotating motor (5), a loading block (9) and a plate-adjusting ring (6); wherein the base (1) is a square arranged on a horizontal plane, wherein each of the two supporting arm assemblies (2) are diagonally installed at both ends of the base (1);

wherein each of the two supporting arm assemblies (2) comprises: a swing arm (2-2), a swing arm shaft (2-4), a swing arm motor (2-1), an adjustable arm (2-3), two rollers (2-5) and a locking knob (2-7); wherein a lower end of the swing arm shaft (2-4) is connected with the swing arm motor (2-1), and an upper end of the swing arm shaft (2-4) is fixed with one end of the swing arm (2-2);

wherein a middle part of the swing arm (2-2) is fixed with a first end of the adjustable arm (2-3), and the two rollers (2-5) are mounted on both the swing arm (2-2) and a second end of the adjustable arm (2-3) in each of the two supporting arm assemblies;

wherein the lapping plate (3) is installed on the swivel gantry (4), the swivel gantry driven to rotate by the rotating motor (5); wherein a bottom surface of the lapping plate (3) is provided with three groups of location pins uniformly arranged along a circumference; wherein three groups of location holes are arranged on the swivel gantry (4) and are matched with the three groups of location pins;

wherein the loading block (9) is encased in the plate-adjusting ring (6), and the quartz crystal wafers (7) are bonded to a bottom surface of the loading block (9);

wherein, first, the quartz crystal wafers (7) are thinned to a certain thickness and are bonded to the loading block (9) with paraffin, and subsequently, two surfaces of the quartz crystal wafer are lapped roughly and finely, respectively, by abrasives of different sizes to remove damage defects on a surface and a subsurface of the quartz crystal wafers (7), with a surface fineness and a damage depth of the subsurface controlled to achieve a required thickness and a surface fineness;

wherein a Mohs hardness of the abrasives is more than 9;

wherein a diameter of abrasive particles is less than 5 μm;

wherein a shape of the abrasive particles is a regular polygon;

wherein a ratio of abrasive weight is 1200# $B_4C$: 5.5%; 1000# SiC: 18.8%; 1000# $Al_2O_3$: 75.7%; with a weight ratio error of no more than 0.3% of a total abrasive weight;

wherein the quartz crystal wafer lapping method further comprises:

a. sticking the quartz crystal wafers: putting the loading block (9) and the quartz crystal wafers (7) on a heating platform and heating the quartz crystal wafers to 80° C.; spreading paraffin on one end face of the loading block (9); placing the quartz crystal wafers (7) on the loading block (9) and squeezing to remove bubbles and excess paraffin; taking the loading block (9) down and putting an object on the loading block to cool the loading block, and then using alcohol to clean up the excess paraffin at an edge of a sheet;

b. debugging of the lapping device: releasing the locking knob (2-7) in each of the two supporting arm assemblies (2), with the swing arm (2-2) of each of the two supporting arm assemblies moved to an outside of the base (1);

putting the lapping plate (3) on the swivel gantry (4); moving back the swing arm (2-2) of each of the two supporting arm assemblies through positioning by the three location pins and the three location holes on the swivel gantry; adjusting an angle of the two rollers (2-5) in each of the supporting arm assemblies (2) to 90°-150° and moving the swing arm (2-2) of each of the two supporting arm assemblies up and down so that the two rollers (2-5) are located at ½ a height of the plate-adjusting ring (6); then adjusting an axial position of the adjustable arm (2-3) of each of the two supporting arm assemblies on a basis of the plate-adjusting ring (6); wherein when the adjustable arm (2-3) of each of the two supporting arm assemblies is moved to an outermost side, the plate-adjusting ring (6) can protrude the lapping plate (3), and when the adjustable arm of each of the two supporting arm assemblies moves to an innermost side, the plate-adjusting ring (6) can pass through a center of the lapping plate (3), then locking the locking knob (2-7) of each of the two supporting arm;

c. adjusting the lapping plate: adjusting a position of a dripping tube (8) and opening a dropper; after the abrasives of different sizes are dripped on the lapping plate (3), placing the loading block on the lapping plate (9) and encasing the plate-adjusting ring on the loading block (6); resetting a speed of the lapping device to zero, opening the lapping device to adjust a rotating speed of the rotating motor (5), and adjusting the swing arm motor (2-1) of each of the two supporting arm assemblies to a maximum speed to adjust the lapping plate (3), after adjusting the swing arm motor (2-1) of each of the two supporting arm assemblies, cleaning the lapping plate (3), loading block (9) and plate-adjusting ring (6) with clean water, then installing the lapping plate (3) according to step b;

d. lapping the quartz crystal wafers: dripping the abrasives of different sizes on the lapping plate through the dropper, wherein the loading block (9) with the quartz crystal wafers bonded to a bottom surface thereof (7) is placed upside down on the lapping plate (3) with the loading block encased with the plate-adjusting ring (6); after setting a lapping duration, opening the lapping device; adjusting the rotating speed of the rotating motor (5) to rotate the lapping plate (3);

wherein the loading block (9) moves back and forth and is horizontally driven by the two rollers (2-5) of one of the two the supporting arm assemblies (2); wherein the lapping device stops running upon reaching the lapping duration;

e. adjusting the lapping plate again: taking the loading block (9), plate-adjusting ring (6) and lapping plate (3) down and washing with clean water, and then adjusting the lapping plate again according to step c;

f. lapping the quartz crystal wafers a second time: a second lapping is made on the quartz crystal wafers (7) according to step d;

g. cleaning: after the second lapping, cleaning the loading block (9), plate-adjusting ring (6) and lapping plate (3) that is bonded with the quartz crystal wafers (7) with clean water;

cleaning the quartz crystal wafers (7) and surroundings thereof with alcohol.

2. The quartz crystal wafer lapping method of claim 1, characterized by: wherein in step c, a weight of the loading block (9) is 5 kg; the rotating speed of the lapping plate (3) is 50 rpm and a duration of adjusting the lapping plate is 20 min.

3. The quartz crystal wafer lapping method of claim 1, characterized by: wherein in step d, a weight of the loading block (9) is 5 kg; the rotating speed of the lapping plate (3) is 50 rpm and the lapping duration is 30 min.

4. The quartz crystal wafer lapping method of claim 1, characterized by: wherein in step f, a weight of the loading block (9) is 5 kg, the rotating speed of the lapping plate (3) is 50 rpm and the lapping duration is 15 min.

5. The quartz crystal wafer lapping method of claim 1, characterized by: wherein the lapping device is further provided with the dropper arranged on a platform behind the base (1), wherein the dropper is provided with the dripping tube; and a discharge port of the dripping tube (8) of the dropper is located above a middle of the lapping plate (3).

6. The quartz crystal wafer lapping method of claim 5, characterized by: wherein in the lapping device, the adjustable arm (2-3) of each of the two supporting arm assemblies is arc-shaped, and wherein an assembly hole with a long hole structure is arranged in a middle of the swing arm (2-2) and at one end of the adjustable arm (2-3) of each of the two supporting arm assemblies, wherein the swing arm (2-2) is fixed to the adjustable arm (2-3) by a bolt assembly (2-6) through the assembly hole of each of the two supporting arm assemblies.

7. The quartz crystal wafer lapping method of claim 6, characterized by: wherein in the lapping device, the swing arm shaft (2-4) is fixedly connected with an output shaft of the swing arm motor (2-1) through the locking knob (2-7) in each of the two supporting arm assemblies.

* * * * *